US006987457B2

(12) United States Patent
Yin et al.

(10) Patent No.: US 6,987,457 B2
(45) Date of Patent: Jan. 17, 2006

(54) WIRELESS FREEZE SENSOR AND ALERT SYSTEM

(76) Inventors: Shumei Yin, 161 Acton St., Carlisle, MA (US) 01741; David B Askey, 161 Acton St., Carlisle, MA (US) 01741

( * ) Notice: Subject to any disclaimer, the term of this patent is extended or adjusted under 35 U.S.C. 154(b) by 62 days.

(21) Appl. No.: 10/855,684

(22) Filed: May 27, 2004

(65) Prior Publication Data

US 2004/0240511 A1 Dec. 2, 2004

Related U.S. Application Data

(60) Provisional application No. 60/474,678, filed on May 31, 2003.

(51) Int. Cl.
*G08B 17/00* (2006.01)

(52) U.S. Cl. ..... 340/584; 340/539.1; 340/580

(58) Field of Classification Search ..... 340/584, 340/539.1, 539.26, 580, 585, 586, 588, 589
See application file for complete search history.

(56) References Cited

U.S. PATENT DOCUMENTS

| | | | | | |
|---|---|---|---|---|---|
| 4,567,474 | A | * | 1/1986 | Wolin | 340/584 |
| 4,855,721 | A | * | 8/1989 | Hallett et al. | 340/585 |
| 5,402,815 | A | * | 4/1995 | Hoch et al. | 137/80 |
| 5,499,024 | A | * | 3/1996 | Germanton et al. | 340/870.17 |
| 5,694,963 | A | * | 12/1997 | Fredell et al. | 137/2 |
| 6,078,262 | A | * | 6/2000 | Young | 340/584 |
| 6,300,871 | B1 | * | 10/2001 | Irwin et al. | 340/539.28 |
| 6,538,578 | B1 | * | 3/2003 | Doherty | 340/905 |

* cited by examiner

*Primary Examiner*—John Tweel, Jr.

(57) ABSTRACT

A freeze detection device that sends a wireless freeze-alert signal when a water freeze condition is detected. The device allows ready installation in areas where traditional freeze detection equipment would require significant effort and expense. The device provides freeze-detecting functionality with very small power consumption, allowing long lasting sensing capability and low maintenance.

19 Claims, 6 Drawing Sheets

WIRELESS FREEZE SENSOR AND ALERT SYSTEM

CROSS-REFERENCE TO RELATED APPLICATIONS

This application claims the benefit of U.S. Provisional Application 60/474,678 filed May 31, 2003.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

BACKGROUND OF THE INVENTION

The present invention relates to freeze sensors that function to detect potential fluid freezes in water pipes and wirelessly transmit a freeze alert signal.

The freezing of pipes in houses and other structures has historically proven to be a significant problem in cold climates. In most cases, pipes in attics, crawl spaces, and other poorly heated or un-heated areas or extremities of the structure will be subject to freezing when the water is left still during prolonged periods of cold.

The ability to detect freeze conditions before freeze onset is an important part of any system that seeks to actively prevent freeze damage. However, the optimal locations for sensing near-freezing temperatures or other freeze conditions are often in areas that would be impractical to reach with AC electrical power. Therefore, the freeze sensor should be self-powered, using a battery or other similar means. The optimal sensing location, such as in a crawl space or basement, may also be remote from areas where a user could easily monitor or avert freeze conditions. In many instances, freeze prevention consists of opening a faucet or a fixture to let water flow through the pipe or pipes in question. Therefore, the ability of the freeze sensor to wirelessly transmit a freeze threat signal to a remote location provides for more flexible placement of sensors and a more user-accessible freeze alert system.

In the past, three general methods of freeze alarms have tried to provide pipe-freeze warnings:

1. A self-contained freeze alarm consists of a battery, temperature sensor, and an audio alarm within one housing. Such a device is shown in U.S. Pat. No. 4,800,371 issued to Arsi in 1989. Since the sensing location is typically far from the heated living space of the building, the alarm may be difficult for a user to hear. If the alarm were made powerful enough to be easily heard, then the batteries powering the alarm would be quickly drained. Further, such an alarm cannot provide freeze condition signals to an automated freeze-prevention system.

2. A household thermostat, with integrated temperature sensor, sends a "low heat" message to a monitoring service if the sensed temperature drops below some threshold temperature. Because the thermostat is not located in the unheated areas of the building where water pipes are most likely to freeze, the sensed temperature at the thermostat gives an extremely inexact indication of freeze likelihood, resulting in either frequent false alarms or alarms issued too late to prevent water freezing.

3. A water-activated alarm that provides an alarm in the event of a water leak is shown in U.S. Pat. No. 5,655,561 issued to Wendel et al on Aug. 12, 1997. Such a device provides an alert too late, after freeze damage has already occurred.

SUMMARY OF THE INVENTION

It is an object of this invention to provide wireless freeze-threat information necessary to prevent the freezing of water within water-carrying pipes of a building. It is a further object of this invention to permit more flexible placement of freeze sensors within a building and therefore provide easier sensor installation and increased reliability of freeze threat detection. It is another object of the present invention that the wireless signal provided by the present invention can be used for a central alert system, building monitoring system, or an automated freeze-prevention system capable of receiving wireless signals.

The present invention allows for an easy and cost effective installation of a freeze condition sensor by using wireless transmission of freeze sensor data, together with internal analysis of sensor data to intelligently control data transmission timing. Transmitted freeze sensor data may activate a freeze prevention system or device such as a flow activation device or heating device. Alternatively, transmitted freeze sensor data may be received by a remote alarm and thereby alert a building occupant about the freeze condition. Transmitted freeze sensor data may also provide notification to a home monitoring service about the freeze condition.

In particular, the present invention contains, as described in the embodiments, an electronic circuit that periodically samples the sensed ambient air temperature in the vicinity of a pipe of concern. The sample interval is predefined in the sensor or is configured by the user through an interface on the sensor housing or through remote command signals. The circuit, which contains a microprocessor, compares the measured temperature with two separate set point temperatures, "freeze threat" and "freeze safe", and decides on whether to transmit a signal indicating "freeze threat" when the sampled temperature has dropped below the predefined "freeze threat" set point or to transmit a signal indicating "freeze safe" when temperature has risen above the predefined "freeze safe" set point. The set point temperatures are predefined in the circuit or are configured by the user through an interface on the sensor housing, or through remote commands.

The freeze sensor's transmission reliability can be improved by transmitting the freeze condition signal multiple times to ensure that the remote system or device receives the signal. In addition, said transmission reliability can be improved by equipping the freeze sensor with a receiver for receiving a confirmation signal from the remote system for which said freeze sensor provides freeze sensing service. In the latter case, the freeze sensor attempts to re-transmit its signal if an expected confirmation is not received.

The present invention provides both a method and a device for use in connection with a climate control system, plumbing control system, alarm system, or building monitoring system capable of receiving wireless signals. When used in combination with a climate control system or plumbing system, the freeze sensor functions to prevent water freeze-up within the water carrying pipes of a building. When used in combination with an alarm system or building monitoring system, the freeze sensor functions to provide an alert about impending water freeze-up conditions.

Several advantages of the present invention are:

(a) Provide easier and faster installations of freeze condition sensors for alert or freeze prevention systems. These freeze sensors are easily installed at any location within about 100–200 feet from the receiver unit;

(b) Allow ready installation in areas where traditional freeze detection equipment would require significant effort and expense;

(c) Provide for ease in retrofit installations, integrating with already installed alarm systems, plumbing systems or environmental control systems capable of receiving wireless signals;

(d) Provide freeze-sensing functionality with very small power consumption, allowing long-lasting sensing capability and low maintenance. This is accomplished by the intelligent transmission of the freeze condition signal only when necessary, which enables at least one year of operation with power supplied by small, inexpensive batteries;

(e) Provide a low battery alert to remind the user of an impending need for battery replacement, enabling uninterrupted service.

While the principal objects and advantages of the present invention have been explained above, a more complete understanding of the invention may be obtained by referring to the description of the preferred embodiment and an alternate embodiment that follow.

DETAILED DESCRIPTION OF THE INVENTION

Figure 1:
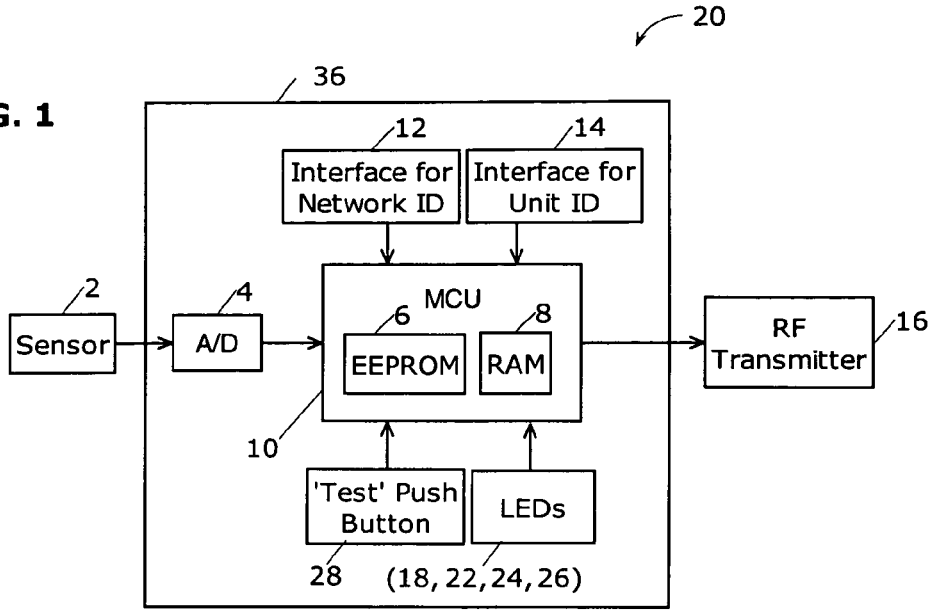
FIG. 1 is a block diagram of a typical arrangement of the preferred embodiment of the present invention, showing key functional components including a typical sensor, in this instance a thermal sensor as the sensor component, a micro-controller unit (MCU), a user interface, and a transmitter module.

The present invention provides a wireless freeze condition signal indicating whether a water pipe is under the threat of freezing. Such signal can be used to provide an effective alert or as input to an automated freeze prevention system. For illustration purposes, without limiting the scope of the invention, the drawings use a thermal sensor as the freeze detection component. The present invention is shown being used as one or more sensing modules for a remote alert system. These illustrations should not be construed as limiting the scope of the invention to the illustrated embodiments.

Referring now in detail to the drawings, the reference numeral 20 denotes generally a freeze sensor in accordance with the preferred embodiment of this invention capable of one-way communication from the freeze sensor to a remote system; the reference numeral 120 denotes generally a freeze sensor in accordance with one typical embodiment that is capable of two-way communication between the freeze sensor and remote system. The freeze sensor is designed with conventional microelectronics including the use of off-the-shelf microprocessor and radio-frequency transmitter components using existing technologies. It is envisioned that a conventional nine-volt battery would provide sufficiently long-lasting (more than a year) electrical power for the device.

Referring now to FIG. 1, shown is a block diagram of freeze sensor 20 according to the preferred embodiment of the present invention, comprised of a set of key functional modules. In particular, freeze sensor 20 contains a freeze detection sensor 2, in this instance, a thermal sensor, which is connected to an A/D converter 4 which is in turn connected to a micro-controller unit (MCU) 10. Two sets of interface means, 12, and 14, are connected to MCU 10 for configuring network ID (NID) and unit ID (UID). A push button 28 is also connected to MCU 10 for toggling between 'test' and 'service' operation modes. LEDs 18, 22, 24, and 26 are operatively connected to MCU 10 to provide visual feedback about functional states of the device. In addition, MCU 10 is operatively connected with RF transmitter 16 that is responsible for transmitting signals to a remote system. Further, MCU 10 (such as an MSP430 product by Texas Instruments Inc.) contains a built-in EEPROM 6, for storing a data-analysis and decision-logic program, and a RAM 8 for storing runtime values.

Continue on FIG. 1. Through interface modules 12 and 14, a user can configure the NID and the freeze sensor UID, respectively. These IDs along with the freeze state (denoted by FREEZE_STATE hereafter) are sent by transmitter 16 as RF signals upon a request by MCU 10 based on an evaluation of a logic program. The remote system of the same NID, upon receiving data from a freeze sensor, uses the NID to ensure that it processes only those data sent from devices in its own network and not those from similar devices of a neighboring network. The remote system uses the UID to identify specific information such as the location of the freeze-threat condition.

Figure 2:
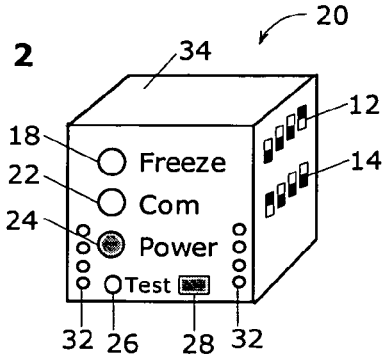
FIG. 2 is a perspective view of the preferred embodiment of the present invention, illustrating both a freeze sensor housing and the user interface.

Referring next to FIG. 2, shown is a perspective view of freeze sensor 20 according to the preferred embodiment of the present invention, with on-off switch banks 12 and 14 for configuring the NID and the UID, respectively. LED 18 lights up when the FREEZE_STATE is '1'. LED 22 lights up when data transmission is active. LED 24 lights up when battery power is present and sufficient, and blinks slowly when battery power is low. LED 26 lights up when freeze sensor 20 is in 'test' mode and is off when freeze sensor 20 is in normal 'service' mode. Pushbutton 28 is for toggling between 'test' and 'service' modes. There is one set of air holes 32 on either side of the front of the housing. They ensure that the thermal sensor senses ambient air temperature.

Figure 3:
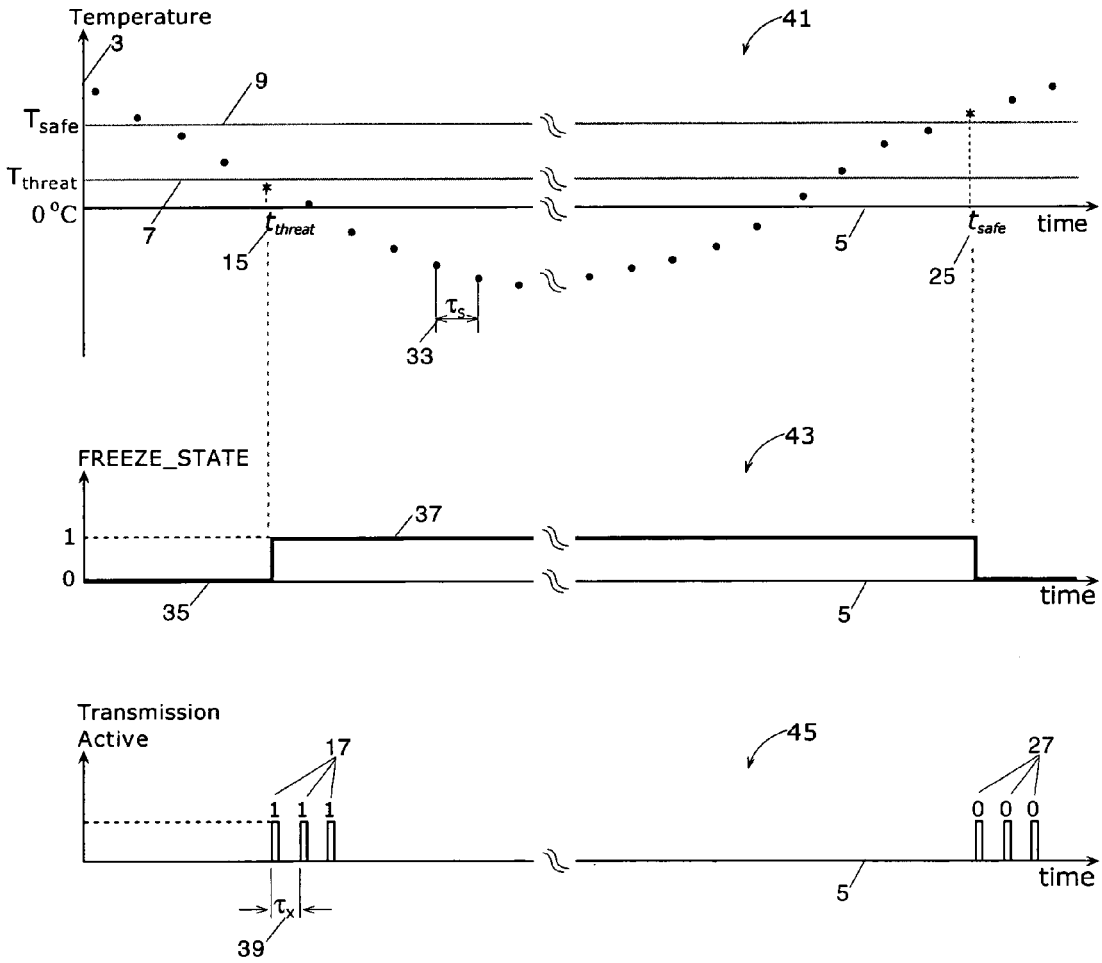
FIG.3 is a temporal view of the freeze condition signal of the preferred embodiment of the present invention, illustrating the freeze condition signal generated by the freeze sensor as a function of the periodically measured temperatures, sampling time interval, and two setpoints.

Referring now to FIG. 3, shown is a temporal view of temperature samples 41 represented in coordinates of temperature 3 versus time 5, a temporal view of the corresponding internal FREEZE_STATE signal 43, and a temporal view of the corresponding transmission state, according to the preferred embodiment of the present invention. Every $\tau_s$ 33 seconds MCU 10 samples the current value of sensor module 2, evaluates a decision logic (illustrated in FIG. 4), and sets the internal FREEZE_STATE 43. The value of FREEZE_STATE is either '0' for freeze-safe state 35 (i.e., no impending freeze condition), or '1' for freeze-threat state 37 (i.e., impending freeze condition exists). Following a state transition (i.e., changing from '1' to '0' or vise versa) of the FREEZE_STATE signal, a preset number of RF transmissions spaced by a transmission time interval, $\tau_x$, are performed as shown in the 'transmission active' temporal view 45.

It is understood by those skilled in the art that the sampling time interval $\tau_s$ 33 and the transmission time interval $\tau_x$ 39 could be made user-configurable by providing additional interface means. However, for simplicity and without losing functional validity and practicality, it is assumed that both time intervals are predefined according to the preferred embodiment of the present invention. Usually, the sampling interval $\tau_s$ 33 is in the range of 1 to 5 minutes for 'service' mode and 10–20 seconds for 'test' mode; the transmission interval $\tau_x$ 39 is about 1 minute for 'service' mode and 5–10 seconds for 'test' mode.

Continue on FIG. 3. Shown in FIG. 3 are two predefined temperature setpoints: $T_{threat}$ 7 and $T_{safe}$ 9 with $T_{threat}$ 7 being lower than $T_{safe}$ 9 usually by about 1–2° C. When MCU 10 detects at sample time $t_{threat}$ 15 that temperature has just dropped below $T_{threat}$ 7, it raises the alert flag by setting its internal FREEZE_STATE signal to '1' 37 and then requests transmitter 16 to send the FREEZE_STATE value along with the NID and UID. Since the preferred embodiment assumes one-way wireless communication from the freeze sensor 20 to the remote system, multiple transmissions are made to increase communication reliability. For simple illustration without loss of generality, the FREEZE_STATE value '1' 37 is shown herein being transmitted three times, separated by transmission interval $\tau_x$ 39, as indicated by the transmitted freeze state signal 17. Once the FREEZE_STATE value '1' has been transmitted three times, further temperature samples do not trigger signal transmissions until the temperature crosses above the setpoint $T_{safe}$ 9. When MCU 10 detects at sample time $t_{safe}$ 25 that temperature has just risen above the setpoint $T_{safe}$ 9, it sets the FREEZE_STATE to '0', and requests that transmitter 16 send the updated FREEZE_STATE value along with NID and UID. Again, for increased reliability of communication, the FREEZE_STATE value '0' is sent three times as shown by the transmitted freeze state signal 27. Those skilled in the art know that one setpoint could be used instead of two separate ones. However, one setpoint could introduce oscillation to the FREEZE_STATE signal when ambient temperature stays in a narrow range around the single setpoint. Therefore, the use of two separate setpoints is preferred for increasing freeze sensor reliability and reducing or eliminating false alerts.

Figure 4:
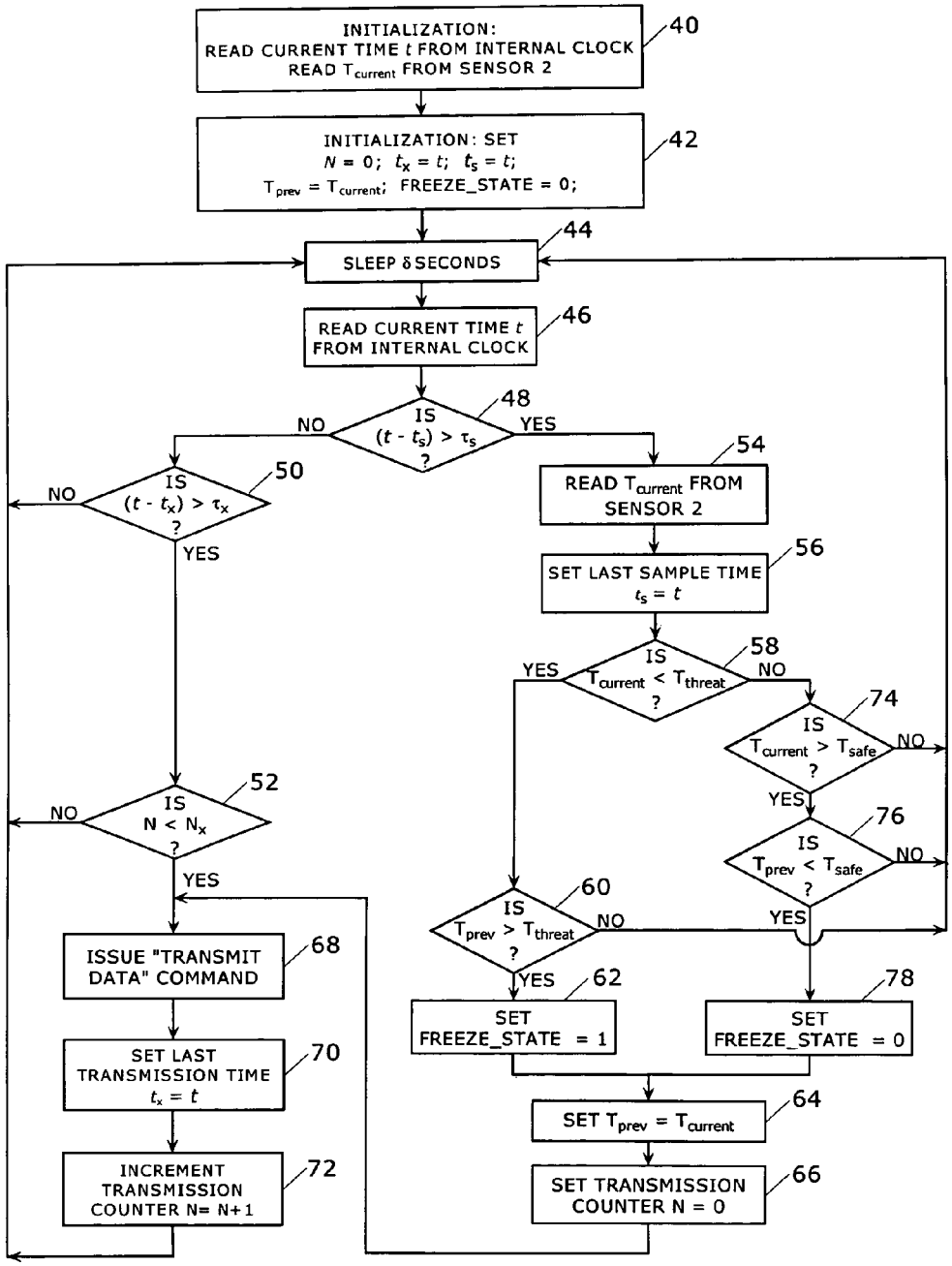
FIG. 4 is a flow chart of the internal decision logic of the freeze sensor according to the preferred embodiment of the present invention.

Referring now to FIG. 4, a flow chart depicting the internal logic periodically evaluated by MCU 10 of freeze sensor 20, according to the preferred embodiment of the present invention. It should be noted that prior to the start of evaluating said logic program, the NED and UID have been stored in internal RAM 8 of MCU 10. It should also be noted that the temperature sampling interval $\tau_s$ 39, the transmission interval $\tau_x$ 19, and the number of transmissions $N_x$ for each state change of the FREEZE_STATE signal are predefined by the freeze sensor and are also stored in the internal RAM 8 of MCU 10.

The program control starts at functional blocks 40 and 42 to initialize variables for the logic program execution loop, where variable $t_x$ represents the time when the freeze state signal was last transmitted and variable $t_s$ denotes the time when the temperature was last sampled. The periodic logic evaluation process starts with a sleep of $\delta$ seconds at block 44, where $\delta$ denotes the time interval in which the logic program is periodically executed. It should be noted that the program execution time interval $\delta$, usually a few seconds, is much smaller than both the sampling time interval $\tau_s$ and the transmission time interval $\tau_x$. After waking up from block 44, control continues at block 46 where the current time t is read from the micro-controller's internal clock. If the time span elapsed since the temperature was last sampled is longer than the preset sampling time interval $\tau_s$, as in the case of the positive outcome of operational block 48, control advances to functional block 54 where the current temperature, $T_{current}$, is read and then to block 56 where the last sample time $t_s$ is updated with the current time value t.

Next, the logic flow continues to operational block 58 where the current temperature, $T_{current}$, is compared with the setpoint $T_{threat}$. If $T_{current}$ is lower than $T_{threat}$ but $T_{prev}$ is higher than $T_{threat}$, as in the case of the positive outcome of operational block 60, the temperature has just dropped below $T_{threat}$, which indicates that the freeze state has just changed from freeze safe to freeze threat. Therefore the following series of actions ensue: set FREEZE_STATE to '1' at block 62; prepare for the next round of logic evaluation by setting $T_{current}$ value equal to $T_{prev}$ at functional block 64; initialize transmission counter N to '0' at functional block 66; issue 'TRANSMIT DATA' command to the transmitter at functional block 68 where the FREEZE_STATE value is transmitted along with the pre-configured NID and UID; update the last transmission time $t_x$ at functional block 70 to hold the current time value t; and increment the transmission counter at block 72. Then control proceeds to block 44 to start the next cycle of logic evaluation.

If $T_{current}$ is greater than $T_{safe}$ but $T_{prev}$ is lower than $T_{safe}$ as in the case of the positive outcome of operational block 76, the temperature has just risen above $T_{safe}$, which indicates that the freeze state has just changed from freeze threat to freeze safe. Therefore control proceeds to set FREEZE_STATE to '0' at block 78 followed by executing functional blocks from 64 through 72 as described above and then proceeds to block 44 to start the next cycle of logic evaluation.

A negative outcome of operational block 60, 74, or 76 indicates that the sensed temperature has not crossed a threshold, so control advances to sleep δ seconds at block 44 as the start of the next cycle of logic evaluation.

Continue on FIG. 4 at operational block 48. If the time elapsed since the last temperature sample does not exceed the sampling time interval $\tau_s$ as in the case of the negative outcome of block 48, control proceeds to block 50 to check whether the time elapsed since the last transmission exceeds the transmission time interval $\tau_x$. The positive outcome of block 50 leads to operational block 52 where the number of transmissions, N, is compared to the maximum number of transmissions, $N_x$, allowed for each state change (i.e., switching from '1' to '0' or vise versa) of the FREEZE_STATE signal. If the transmission counter N is less than $N_x$, control advances to the following actions: issue "TRANSMIT DATA" command at block 68 requesting that the transmitter send the current FREEZE_STATE value along with the NID and UID; set last transmission time $t_x$ to the current time value t at block 70; then increment the transmission counter at block 72. Then control completes the current cycle of the logic evaluation upon the completion of block 72 and proceeds to block 44 to begin the next cycle. If the time elapsed since the last transmission is less than the transmission time interval $\tau_x$ as in the case of the negative outcome of block 50 or if the current FREEZE_STATE has been transmitted at least $N_x$ times as in the case of the negative outcome of block 52, control advances to block 40 to start the next cycle.

Figure 5:
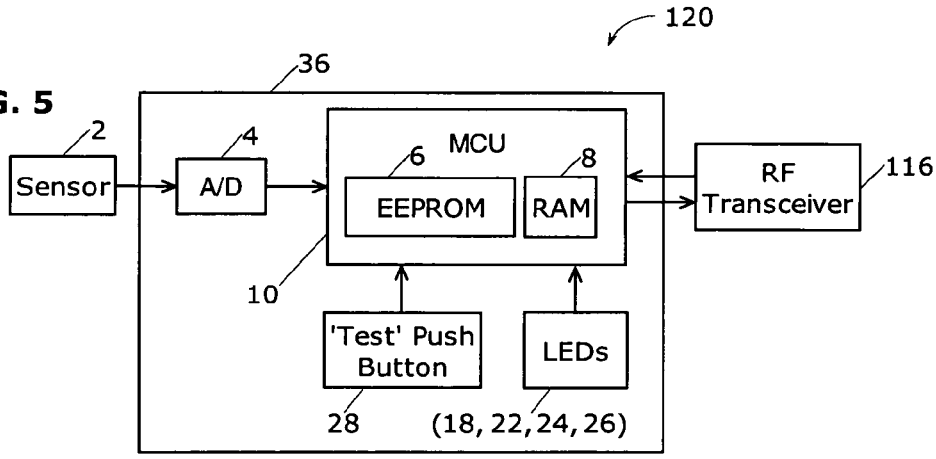
FIG. 5 is a block diagram of a typical arrangement of one embodiment of the present invention, showing the use of a transceiver capable of two-way communication.

Referring now to FIG. 5, shown is a block diagram of a freeze sensor 120 according to an alternate embodiment of the present invention, comprised of a set of key functional modules. In particular, freeze sensor 120 contains a freeze detection sensor 2, in this instance, a thermal sensor, which is connected to an A/D converter 4 which is in turn connected to a micro-controller unit (MCU) 10 that contains built-in EEPROM 6 for storing a data-analysis and decision-logic program and RAM 8 for storing runtime values. LEDs 18, 22, 24, and 26, which provide visual feedback on functions of the freeze sensor, are also connected to MCU 10. RF transceiver 116, also connected to MCU 10, enables two-way communication between the freeze sensor 120 and the remote system. Messages sent from freeze sensor 120 are either a freeze state signal or a low-battery warning signal. Each signal is transmitted along with the network ID and unit ID. Messages received from the remote system are one of the following types: a confirmation of a received signal, a command for configuring network ID, unit ID and temperature sampling period, or a command to start operation of 'test' mode or 'service' mode.

Figure 6:
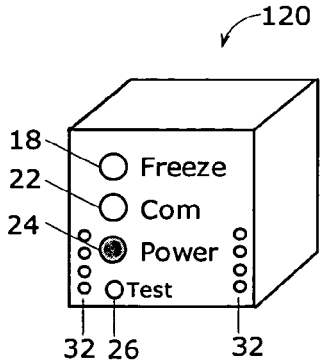
FIG. 6 is a perspective view of one embodiment of the present invention, illustrating a freeze sensor housing for the components of FIG. 5 residing therein

Next referring to FIG. 6, shown is a perspective view of freeze sensor 120 according to an alternate embodiment of the present invention. The functions of LEDs 18, 22, 24, and 26, and the function of air holes 32 are the same as those described for FIG. 2. The switching between the 'test' and 'service' modes is now activated by commands from a remote system.

Figure 7:
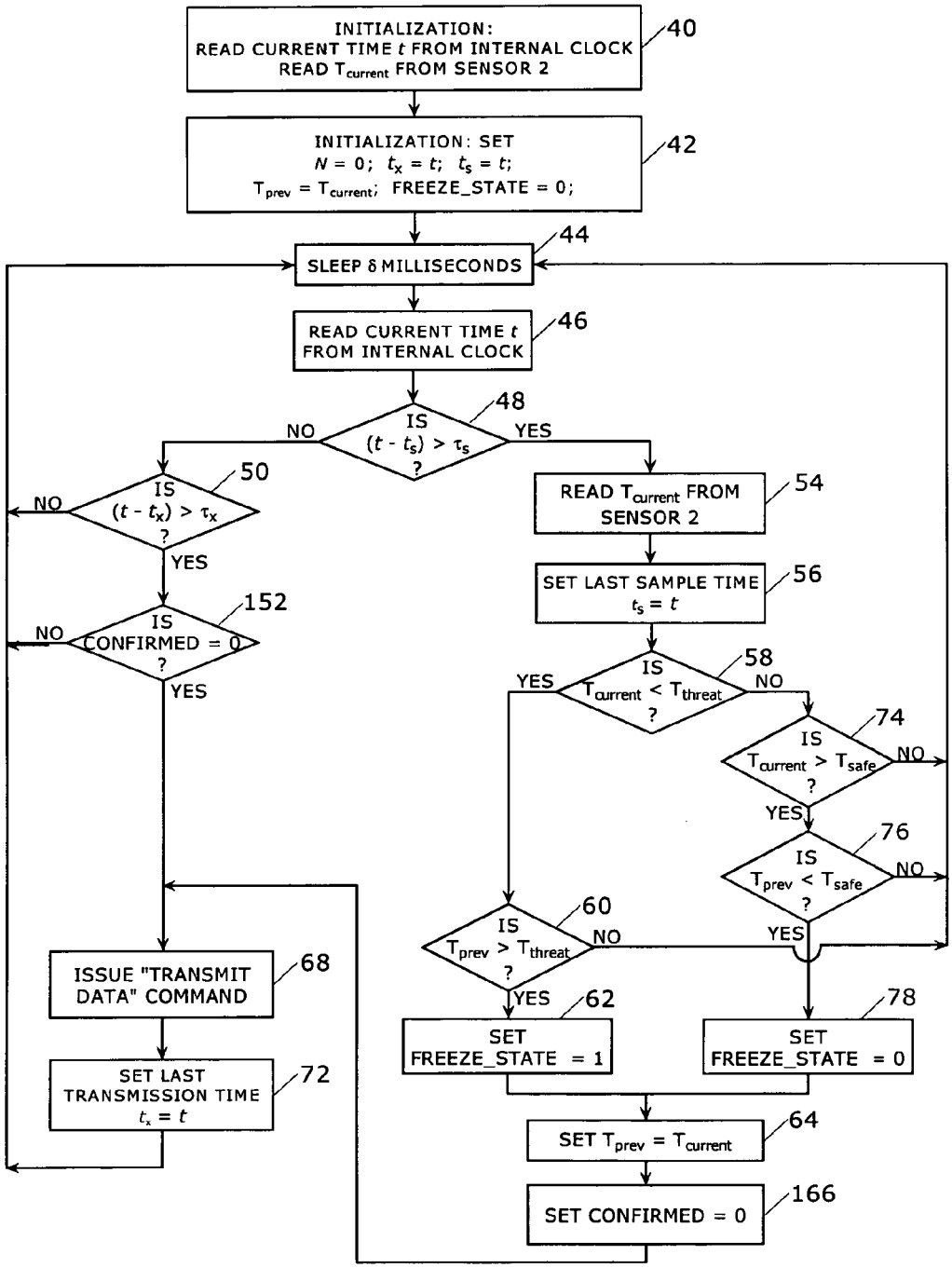
FIG. 7 is a flow chart of the internal decision logic of one embodiment of the present invention.

Referring now to FIG. 7, a flow chart depicting the internal logic periodically evaluated by MCU 10 of freeze sensor 120, according to an alternate embodiment of the present invention. The difference between the logic of the preferred embodiment shown in FIG. 4 and that of an alternative embodiment shown in FIG. 7 lays in the method of ensuring reliability of communication between the present invention and the remote system. The preferred embodiment transmits the signal multiple times to increase the chances that the remote system will receive the signal; the alternate embodiment expects a confirmation message from the remote system and re-transmits the signal until a confirmation is received. In particular, referring to FIG. 7, operational block 152 and functional block 166 are the only two blocks different from the corresponding ones in FIG. 4. When the FREEZE_STATE signal transitions from '1' to '0' or from '0' to '1' as in blocks 62 and 78, flag CONFIRMED is set to '0' to initialize the confirmation-checking process. When the time elapsed since the last transmission exceeds the transmission interval $\tau_x$ as in the case of the positive outcome of operational block 50, flag CONFIRMED is checked at block 152. A value of '0' indicates that the expected confirmation has not been received. The program control then continues to "TRANSMIT DATA" at block 68 and update the last transmission time $t_x$ to the current time t, and then the cycle continues anew at block 44. It should be noted that there is a separate interrupt routine (not shown in FIG. 7) processed by MCU 10 upon an interrupt generated by transceiver 116 when a message is received. The said interrupt routine inspects the received message and sets flag CONFIRMED to '1' if the message confirms receipt by the remote system of a recent freeze state signal transmission.

Figure 8:
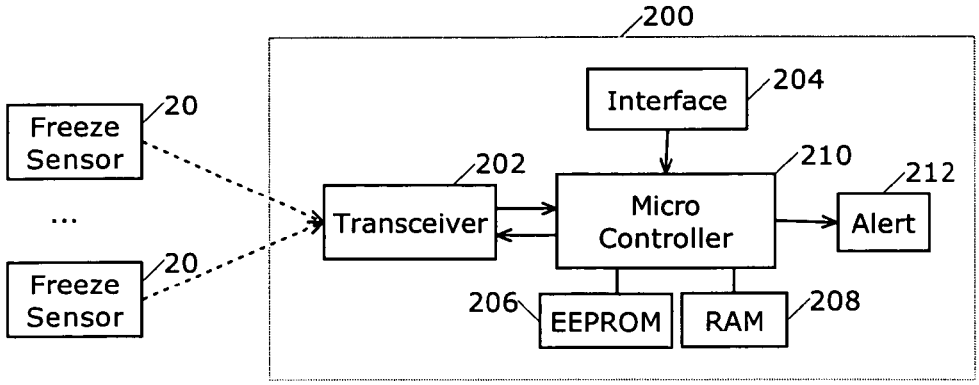
FIG. 8 is a block diagram showing a plurality of the present invention, in its preferred embodiment, being used as sensing modules for an existing alert system. Said alert system typically includes a transceiver module, a micro-controller unit, and an alert module.

The present invention as described in FIGS. 1–7, can be used as a freeze-sensing module for an automated freeze prevention system or for providing an effective and reliable freeze alert to a central monitoring system. As an example illustrating the usage of the present invention in such applications, FIG. 8 shows that a multiplicity of the preferred embodiment of the present invention 20 are used as sensing modules for an existing alert system 200. The alert system 200 contains a transceiver 202 for receiving the freeze state signal among other types of signals the alert system is designed for. Transceiver 202 is connected to micro controller 210 that operatively connects with user interface module 204 and alert/alarm module 212. The user interface module 204 provides means for entering configuration settings including settings for the freeze sensors (such as network ID, unit ID) and for issuing command for operation modes. The alert/alarm module 212 could be a simple audio alarm or capable of dialing a phone number to leave a message or sending an email text message. The EEPROM 206 contains the configuration parameters, device information, and email addresses or phone numbers needed for dispatching the alert message.

Figure 9:
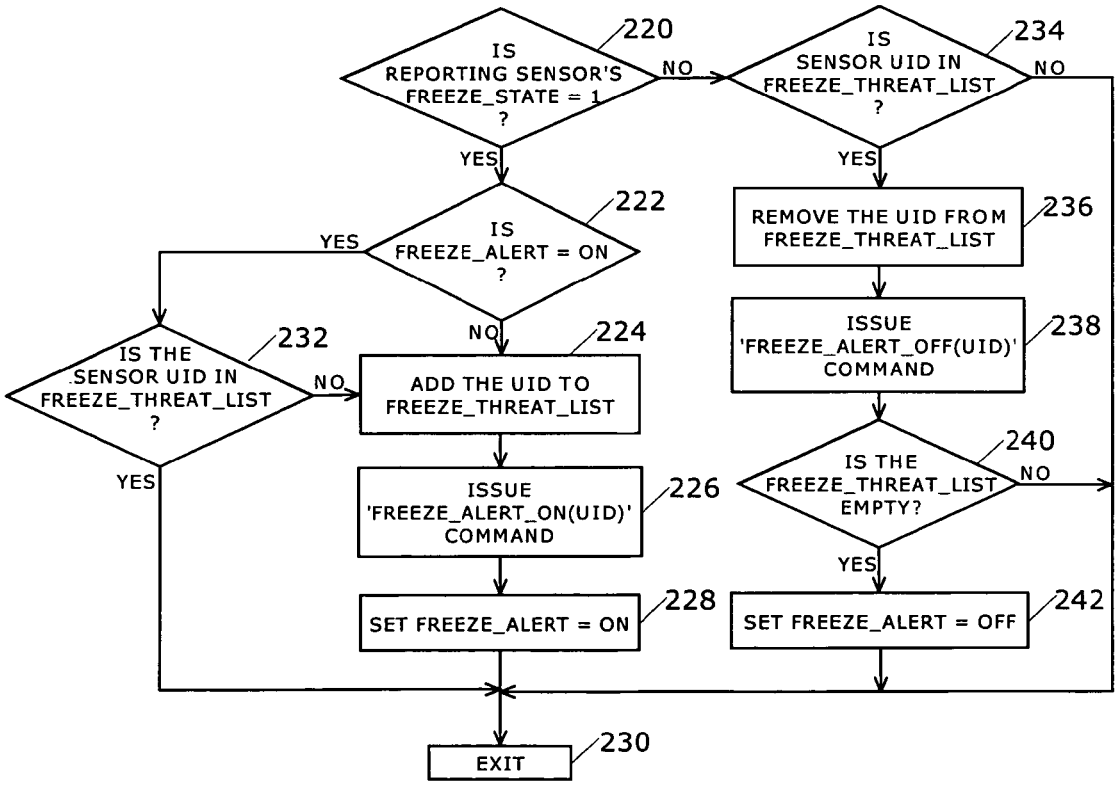
FIG. 9 is a flow chart of the freeze alert decision logic, adapted into an existing alert system as in FIG. 8. Said decision logic is evaluated by the micro-controller of the alert system when said micro-controller receives a signal from one of the freeze sensors.

Referring to FIG. 9, shown is a flow chart of logical operations for managing freeze alarm/alert, adaptable into an existing central alert system 200. Upon receiving a freeze state signal from one of the freeze sensors 20, micro controller 210 executes the program shown in FIG. 9. Generally, the alert system keeps a FREEZE_THREAT_LIST that contains the UIDs of those freeze sensors that have detected a freeze threat condition, i.e., whose FREEZE_STATE has changed from '0' to '1'. This list can provide specific location information for the freeze threat condition. When the FREEZE_THREAT_LIST is not empty, the alert system's FREEZE_ALERT flag is set to 'ON', otherwise to 'OFF'. This flag could be linked to a visual alert such as an LED on the alert system housing, an audio alarm, or a text message sent to predefined destinations. If a freeze sensor reports FREEZE_STATE=1 as in case of the positive response of operational block 220, the sensor's UID is added to the FREEZE_THREAT_LIST at block 224 if it is not already in the list. Each time a new freeze threat is detected, control issues a FREEZE_ALERT_ON command (block 226) that sets an alarm or sends an alert associated with the specific reporting sensor. On the other hand, each time when a freeze sensor clears its freeze threat state (i.e., FREEZE_STATE changes from '1' to '0'), control sends a FREEZE_ALERT_OFF command (block 238) that cancels the corresponding alarm or clears the corresponding alert associated with the reporting freeze sensor.

Figure 10A:
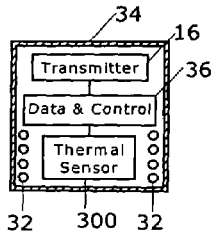
FIG. 10A is a cross-sectional view of the preferred embodiment of the invention, showing a typical sensor and transmitter module configuration, in this instance, a thermal sensor as the freeze detection sensor.

FIGS. 10A–10D are cross-sectioned, elevation views of some typical freeze sensor component embodiments. FIG. 10A shows a thermal sensor 300 as the freeze detection sensor according to the preferred embodiment of the present invention. Thermal sensor 300 is connected to a data analysis and control unit 36 that is in turn connected to a transmitter 16. Air holes 32 in the freeze sensor housing 34 permit thermal sensing of ambient air temperature.

Figure 10B:
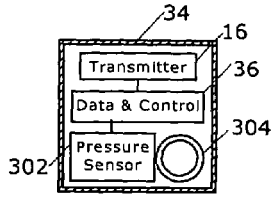
FIG. 10B is a cross-sectional view of one embodiment of the invention, showing a pressure sensor as the freeze detection sensor.

FIG. 10B shows another embodiment, in particular, replacing the thermal sensor 300 of FIG. 10A with a pressure sensor 302 attached to a pipe connection fitting 304 in the freeze sensor housing 34. In this embodiment, water pressure within the attached pipe is sensed by pressure sensor 302 and is passed to the data analysis and control circuit 36 that decides on the freeze state based an evaluation of a logic program. Said logic program is much the same as that shown in FIG. 4 or FIG. 7.

Figure 10C:
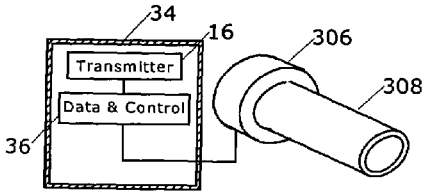
FIG. 10C is a cross-sectional view of one embodiment of the invention, showing a non-integrally housed sensor and transmitter.

FIG. 10C shows an embodiment where pressure sensor 306 is located outside the freeze sensor housing 34 and is connected to a data analysis and control unit 36 that is in turn connected to a transmitter 16. Such an arrangement allows existing pressure sensing devices to be upgraded to provide freeze alert functionality.

Figure 10D:
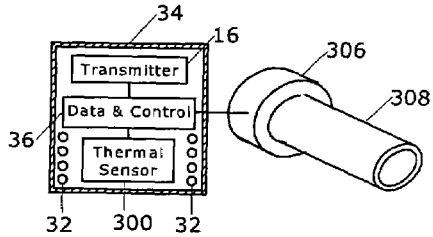
FIG. 10D is a cross-sectional view of one embodiment of the invention, showing the combination of more than one freeze condition sensor connected to the transmitter module, in this instance, a thermal sensor and pressure sensor.

FIG. 10D shows another embodiment with more than one freeze condition sensor connected to the data analysis and control unit 36, in this instance, a thermal sensor 300 and pressure sensor 306. Both sensors are connected to a data analysis and control unit 36 that is in turn connected to a transmitter 16.

To use the present invention in association with an alert system or an automatic freeze prevention system capable of receiving wireless signals, one needs to place one or more freeze sensors developed according to the present invention in locations next to water pipes that are most susceptible to freeze when temperature falls below freezing, especially unheated areas. Up to 16 such freeze sensors can be deployed for each said system. Each freeze sensor in said system should be assigned a unique UID, while all freeze sensors in one system should have the same NID as that of said system. If the temperature stays above the predefined $T_{threat}$ (usually at around 1° C.), the alert system will not receive any signal from said freeze sensors. Once the temperature drops below the $T_{threat}$ at the location of one of the sensors, the alert system should receive a freeze threat signal that causes the alert system to set its alarm and/or send an alert message as configured. Once the temperature rises above the $T_{safe}$ level (usually higher than $T_{threat}$ by 1–2° C.), the alert system should receive a freeze safe signal that clears the alert associated with the reporting freeze sensor.

While the above illustrations and description contain many specifics, these should not be construed as limitations on the scope of the invention, but rather as an exemplification of preferred embodiments thereof. Many other variations are possible. For example, the transmitted freeze state signal does not have to be either 0 or 1 and need not be sent a limited number of times after the freeze state changes. Instead said signal could be derived from some other manipulation, e.g., a proportional operation, on the outputs of the freeze detection sensor (2 in FIG. 1 and FIG. 5), and all samples measured from the time when the temperature drops below $T_{threat}$ until the time when the temperature rises above $T_{safe}$ could be transmitted. A particular example is that the transmitted signal is simply the temperature measurements between $t_{threat}$ and $t_{safe}$ as in the temporal view of temperature 41 in FIG. 3. In such embodiments, the freeze state decision logic programs illustrated in FIG. 4 and FIG. 7 and the alert management logic in FIG. 9 can be easily adapted by those skilled in the art. Further examples of other variations of the described embodiments of the present invention include using dials as interfaces for configuring the NID and UID, or input key pads combined with an LCD display (an expensive option), or remote configuration commands sent from any wireless device or computer that can communicate with the transceiver of the invention.

We claim:

1. A freeze detection device comprising:

a housing;

a source of electrical power;

a freeze-sensing means that senses and represents the temperature of its surroundings as an electronic signal;

a decision unit that decides if a freeze condition has developed or resolved based on comparisons of data from said freeze-sensing means with predefined set points;

a transmitting means for generating a wireless signal responsive to said decision unit.

2. The freeze detection device according to claim 1, wherein said freeze-sensing means is a thermal sensor, or a temperature-correlated pressure sensor, or a combination of the two types of sensors.

3. The freeze detection device according to claim 1, wherein said decision unit periodically samples the signal of said freeze-sensing means and causes said transmitter to start generating a signal indicating "freeze threat" when the sampled value falls below a predefined "freeze-threat" set point and causes said transmitter to start generating a signal indicating "freeze safe" when the sampled value rises above a predefined "freeze-safe" set point.

4. The freeze detection device of claim 3, wherein said freeze condition signals ("freeze threat" and "freeze safe") are transmitted periodically for a predefined period of time.

5. The freeze detection device of claim 3, wherein said freeze condition signals ("freeze threat" and "freeze safe") are periodically transmitted until a confirmation signal is received by said decision unit.

6. The freeze detection device of claim 3, wherein said predefined "freeze safe" set point correlates to a higher temperature than said predefined "freeze threat" does.

7. The freeze detection device according to claim 1, wherein said decision unit includes a storage means for storing said predefined operational parameters.

8. The freeze detection device according to claim 7, wherein said predefined operational parameters comprises an identification number of said device, predefined set points used by said decision unit, and other constant values used by said decision unit that remain constant during said device's functional operation and can only be adjusted through a configuration means.

9. The freeze detection device according to claim 7, wherein said storage means is connected to a configuration means for setting predefined operational parameters.

10. The freeze detection device according to claim 8, wherein said configuration means is one or more of the following means for adjusting said operational parameters either directly at said device or indirectly from a remote unit:

(a) A user interface display and adjustment controls, each mounted on said housing, that allow adjustments of said operational parameters;

(b) A wireless signal receiver, mounted on said housing, capable of receiving configuration signals sent from a remote device, PDA, cellular phone, cordless phone, or computer that sends the set points to said device wirelessly;

(c) A data cable connecting between said housing and a remote control device, PDA, or computer that sends the set points to said device via said data cable.

11. The freeze detection device of claim 1, comprising additionally an audible alarm means for producing an audible alarm, wherein said audible alarm means is caused to operate in response to said decision unit's signal.

12. The freeze detection device of claim 1, comprising additionally visual indication means for flashing a light emitting diode, wherein said visual indication means is caused to operate in response to said decision unit's signal.

13. The freeze detection device according to claim 1, wherein the freeze alert actions initiated by said decision unit include one or more of the following:

(a) Transmitting an alert signal along with said device's identification number to an alert service system capable of receiving remote signals;

(b) Actuating mechanisms that induce water-flow or heating means to prevent water freeze inside pipes;

(c) Transmitting alert signal along with said device's identification number to a central freeze control unit;

(d) Transmitting said freeze signals to a computer capable of receiving remote signals.

14. The freeze detection device according to claim 1, comprising additionally a "low power" alarm means for flashing a light emitting diode when voltage provided by said source of electrical power falls below a pre-determined level.

15. The freeze detection device according to claim 1, wherein said decision unit causes the transmitter to generate a "device alive" signal periodically, with the time period being much larger than that at which a freeze condition signal, "freeze threat" or "freeze safe", is transmitted.

16. A method of detecting freeze conditions comprising the steps of:

(a) periodically sampling a freeze-sensing device that senses temperature or temperature-correlated values;

(b) identifying the direction of the change of the sampled values;

(c) identifying a "freeze threat" condition as a set of decreasing sampled values together with a sampled value that has crossed below a predefined "freeze threat" set point;

(d) identifying a "freeze safe" condition as a set of increasing sampled values together with a sampled value that has crossed above a predefined "freeze safe" set point.

17. The method according to claim 16, wherein said predefined "freeze threat" set point correlates to a lower temperature value than said predefined "freeze safe" set point, and both set points are above the value correlated to the freezing-point temperature (0° C.).

18. The method according to claim 16, wherein steps (c) and (d) further include transmitting said freeze condition signals a predefined number of times in order to conserve electrical power and provide long lasting sensor functionality.

19. The method according to claim 16, wherein steps (c) and (d) further include transmitting said freeze condition signals periodically until said decision unit receives a confirmation signal.

* * * * *